United States Patent [19]

McChesney et al.

[11] 4,454,833

[45] Jun. 19, 1984

[54] LIQUID DEVELOPER APPARATUS

[75] Inventors: John L. McChesney, Cupertino; Ballard French, Palo Alto, both of Calif.

[73] Assignee: Xerox Corporation, Stamford, Conn.

[21] Appl. No.: 517,158

[22] Filed: Jul. 25, 1983

[51] Int. Cl.[3] ..... G03G 15/06; G03G 15/10

[52] U.S. Cl. ..... 118/651; 118/118; 118/661; 355/10

[58] Field of Search ..... 118/651, 661; 355/10

[56] References Cited

U.S. PATENT DOCUMENTS

| | | | |
|---|---|---|---|
| 3,203,395 | 8/1965 | Liller | 118/647 |
| 3,256,855 | 6/1966 | Oliphant | 118/647 |
| 3,367,791 | 2/1968 | Lein | 430/119 |
| 3,560,204 | 2/1971 | Damm | 430/118 |
| 4,141,317 | 2/1979 | Lakhani | 118/661 |

FOREIGN PATENT DOCUMENTS

| | | |
|---|---|---|
| 2238404 | 2/1973 | Fed. Rep. of Germany . |
| 56-35634 | 4/1981 | Japan . |

OTHER PUBLICATIONS

Pages 1-1, 1-2, 1-6, 5-57, 5-58, FIGS. 8-1(*a*), 8-2(*a*) & 8-1(*g*) from the Operating Manual from the 9300 Series of Benson Printer/Plotters.

*Primary Examiner*—Bernard D. Pianalto
*Attorney, Agent, or Firm*—W. Douglas Carothers, Jr.

[57] ABSTRACT

A liquid developer apparatus for developing an electrographic latent image formed on an image bearing surface of a recording medium wherein the liquid developer is applied to a region of a rotated applicator roll with flow controlling means positioned in spaced relation to the surface of the applicator roll to meter the amount of liquid developer applied to and carried by the applicator roll. The flow controlling means provides for uniform supply of liquid developer to a meniscus formed in a development gap formed between the moving recording medium and the applicator roll. The development gap is formed with the aid of a backrest electrode positioned opposite to the applicator roll over which the medium travels through the development gap. The backrest electrode may comprise a rotatably mounted roll. A bias is applied to the applicator roll and an opposite bias is applied to the backrest electrode to improve image contrast and to adjust image quality relative to the particular type of liquid developer and recording medium being employed. Image quality may be further adjusted according to liquid developer and recording medium tolerances by selectively adjusting the width of the development gap through movement of the backrest electrode relative to the applicator roll. The toned image is dryed with a dry roll in engagement with the moving medium down stream from the applicator roll and rotated in a direction opposite to the direction of movement of the medium. A bias is applied to the drying roll to effectively erase loosely attached toner particles on the image bearing surface and thereby prevent dryer roll smearing of the image.

9 Claims, 3 Drawing Figures

LIQUID DEVELOPER APPARATUS

BACKGROUND OF THE INVENTION

This invention relates to an apparatus for applying liquid developer to the surface of a recording medium moving in a path relative to the apparatus and more particularly relates to a biased development zone in which the liquid developer is applied to an image bearing surface of the recording medium through the establishment of a toner meniscus in a toning gap established between the rotating applicator roll and the moving recording medium.

The art of liquid toning of a previously formed electrographic latent image formed on the image bearing surface of a recording medium with a liquid toner or developer is a well established art. The applicator roll is partly submerged in the liquid developer bath provided in a receptacle and the applicator roll is rotated at a sufficiently high velocity so as to raise liquid developer from the bath in the form of a thin toner film on the surface of the roll due to viscous friction. The moving recording medium is brought into spaced proximity with the upper surface of the applicator roll forming a toning gap. Due to the rotational velocity of the applicator roll and also possibly (1) the application of an electrical field across the toning gap or (2) a bias applied either to a back electrode, positioned opposite of the applicator roll, or a bias applied to the applicator roll or a bias applied to both the back electrode and the applicator roll, the maintenance of a toning meniscus in the toning gap can be assured with the desired density level of toning particles, entrained in the liquid developer, being controlled as applied to the image bearing surface. The bias may as well reduce undesirable background staining of the medium as it passes the developer apparatus, which staining reduces toned image contrast and quality. Examples of this art which are relevant to the instant invention are found in the following patents and publications: U.S. Pat. Nos. 3,203,395; 3,256,855, 3,367,791; 3,560,204; and 4,141,317; Japanese Utility Model Laid Open Publication 56-35634; German Offenlegungsschrift (OLS) 2,238,404; and the Benson Electrostatic Printer/Plotter, Model 9336, manufactured by the Benson, P.O. Box 32059, 2600 Orchard Parkway, San Jose, CA 95152.

Probably the most representative of these references to the instant invention is the German OLS 2,238,404. This reference discloses in FIG. 3 the combination of an applicator roll and backrest electrode to which are applied a bais field and which are maintained in a spaced relation to forming a toning gap therebetween. The rotation of the applicator roll, partly submerged in liquid developer, causes the roll to pick up liquid developer supply a meniscus created in the toning gap and in contact with the moving recording medium. The applicator roll is disclosed as being rotated at high speed in a direction opposite to the direction of medium movement, although reference is made that roll can be rotated in the same direction as the direction of medium movement.

Further, the employment of drying rolls are also disclosed in German OLS 2,238,404 down stream from the applicator roll, which roll is rotated in the same direction as the direction of medium movement. However, from the Japanese Laid Open Publication56-35634, it is known to rotate the drying roll in a direction opposite to medium movement.

While such a known liquid developer apparatus may have good application in applying liquid developer to the image bearing surface of a recording medium in the form of a meniscus in a toning gap between two conductive surfaces, the application is still plagued by certain problems. For expamle, except for rotational velocity adjustment of the applicator roll relative to the viscosity of the liquid developer, it is not always practical to obtain, on a continuous and systematic basis, the same amount of liquid developer on the surface of the applicator roll due to developer viscosity changes or changes in temperature or rotational velocity of the applicator roll. What is desired is some means by which the thin film of liquid developer developed on the applicator roll surface is maintained uniform regardless of changes in the above mentioned parameters.

Another problem is the elimination of background stains when the recording medium is momentarily stopped during the continuous application of liquid developer. While the source of developer may be stopped, the formed meniscus at the toner gap will stell remain for a short period of time, toning the image bearing surface of the stopped medium in the stopped position. What is needed is some means by which good image quality can be maintained during medium movement by good developer application at the toner gap with properly applied potentials and the almost instantaneous removal of the formed meniscus when the medium is stopped.

Still a further problem is the elimination of toner particle smearing at the drying roll which not addressed in the prior art.

Still another problem is the reduction of toner buildup on the surface of the applicator roll due to continuous use which effects the toner drawing capabilities of the roll as well as the density and quality of the toned image.

These problems are substantially eleviated by the liquid developer apparatus of the instant invention.

SUMMARY OF THE INVENTION

According to this invention, a liquid developer apparatus is provided for developing an electrographic latent image formed on an image bearing surface of a recording medium wherein the liquid developer is applied to a region of a rotated applicator roll with flow controlling means positioned in spaced relation to the surface of the applicator roll to meter the amount of liquid developer applied to and carried by the applicator roll. The flow controlling means provides for uniform supply of liquid developer to a meniscus formed in a development gap formed between the moving recording medium and the applicator roll. The development gap is formed with the aid of a backrest electrode positioned opposite to the applicator roll over which the medium travels through the development gap. The backrest electrode may comprise a rotatably mounted roll.

A bias is applied to the applicator roll and an opposite bias is applied to the backrest electrode to improve image contrast and to adjust image quality relative to the particular type of liquid developer and recording medium being employed. Image quality may be further adjusted according to liquid developer and recording medium tolerances by selectively adjusting the width of the development gap through movement of the backrest electrode relative to the applicator roll.

The toned image is dryed with a dry roll in engagement with the moving medium down stream from the applicator roll and rotated in a direction opposite to the direction of movement of the medium. A bias is applied to the drying roll to effectively erase loosely attached tone particles on the image bearing surface and thereby prevent dryer roll smearing of the image.

Other objects and attainments together with a fuller understanding of the invention will become apparent and appreciated by referring to the following description and claims taken in conjunction with the accompanying drawings.

DETAILED DESCRIPTION OF THE PREFERRED EMBODIMENT

Figure 1:
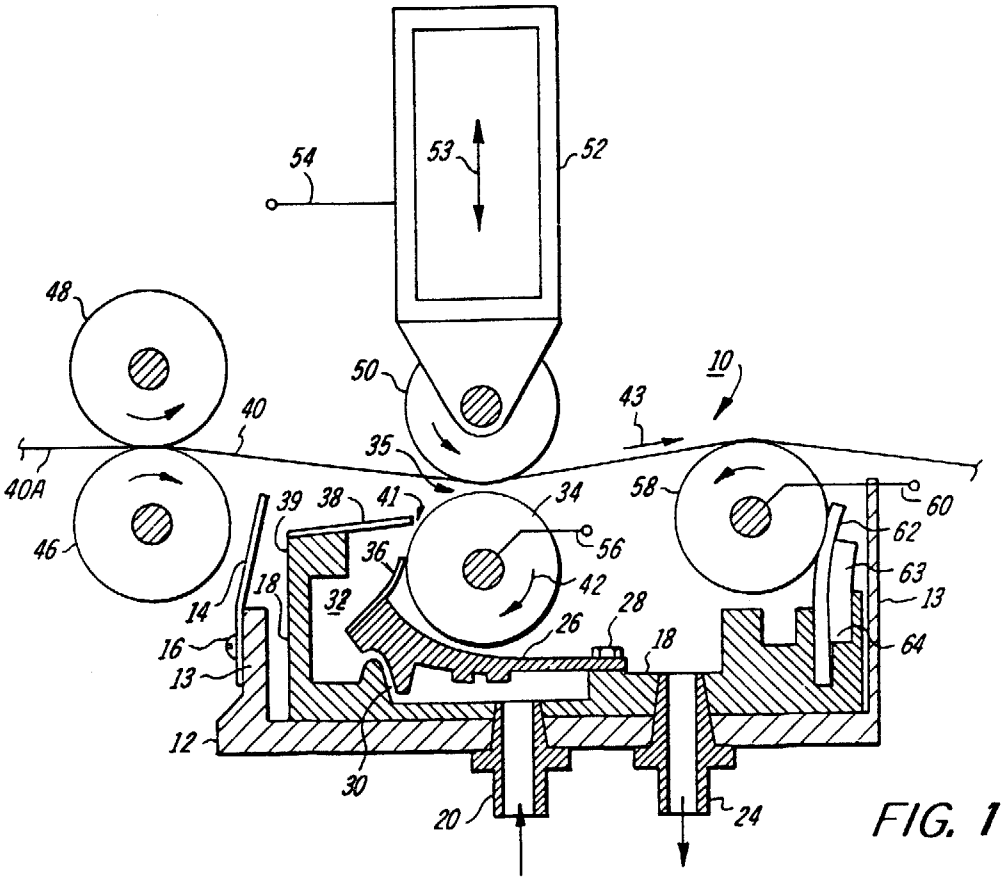
FIG. 1 is a cross-sectional view of the liquid developer apparatus of the instant invention.
Figure 2:
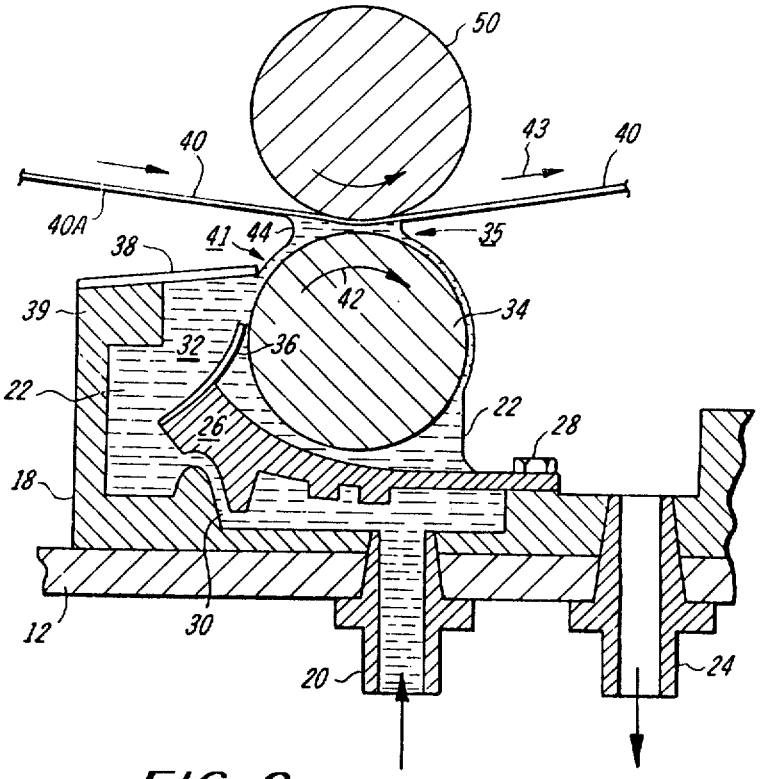
FIG. 2 is an enlarged cross-sectional view of the liquid developer sectional view of the liquid developer apparatus of FIG. 1 with liquid toner or developer being applied thereto.

Reference is now made to FIGS. 1 and 2 wherein there is illustrated a liquid developer apparatus 10 comprising this invention for toning or developing a moving recording medium 40 having an image bearing surface 40A. Throughout the following description, the terms "toner", "developer", "liquid toner" and "liquid developer" are used interchangably to indicate a developer having entrained toner particles (e.g. carbon) in a liquid carrier medium for developing a latent electrosatic image on the surface 40A. As well known in this area of art, medium 40 comprises a paper based, substantially conductive substrate with thin dielectric coating forming a charge retaining surface 40A. Also, medium 40 could be a dielectric transparent or opaque film having a charge retaining surface 40A.

Apparatus 10 comprises a support frame 12 with perimetral side wall 13. The forward side wall is provided with a splash guard 14 secured to the side wall with fasteners 16.

Within the support frame 12 is mounted a fountain frame 18. Frame 18 has an inlet 20 for liquid developer 22 supplied from a pumping source (not shown) at a rate, for example, of 2 gallons per minute, and an outlet 24 for the return of spent liquid developer to be returned to the pumping source. Within the fountain frame 18 mounted at 28 is a liquid developer path and control unit 26 which functions to provide a labyrinth path 30 for the flow of liquid developer 20 to region or area 32 of apparatus 10. The path 30 provides for uniform and smooth flow of the developer into region 32.

Applicator roll 34 is mounted for rotational movement above unit 26. Roll 34 is driven by a motor (not shown) to rotate at a velocity from between 200 rpm and 1000 rpm. As is evident from an examination of FIG. 1, applicator roll 34 rotates in the same direction as the direction of movement of the recording medium 40 as indicated by arrow 43. Roll 34 may comprise chrome plated steel with a highly polished mirror finish and may be, e.g., one inch in diameter.

The rotary action of the applicator roll 34 is helpful in three major ways. First, the viscous friction of the applicator roll draws toner out of the region 32 into the region of the printing gap 35. Secondly, the rotating roll 34 pulls excess toner off of the moving medium 40 as the medium moves past the position of the applicator roll 34. Third, the forces of the rotary motion tend to throw toner particles entrained in the liquid developer away from the applicator roll 34 so that they are instantly available for toning the surface of the recording medium. This action also limits the amount of toner particles that "plate out" on the applicator roll 34.

If the flow of liquid developer to the applicator roll is reversed, i.e., the region 32 is provided on the opposite side of roll 34 and roll 34 is rotated in the opposite direction to the direction of medium movement, roll 34 then deposits toner on the recording medium as the medium moves pass the roll 34 which creates high toner background stain and an overtoning condition wherein excess toner particles leave a "fog" appearance around the toned image.

A doctor blade 36 is mounted along the outer edge of the path and control unit 26 to be supported against the rotary movement 34. Blade 36 is made of flexible material, e.g. urethane or Mylar, to be continuously biased against the surface of the applicator roll 34 and to wipe from its surface liquid developer and any attached toner particles which then passes down over the upper surface of unit 26 to outlet 24. Blade 36 is typically, for example, a 4 mil Mylar material.

A flow controller 38 is mounted on the rearward edge 39 of the fountain unit 18 in spaced relation to the applicator roll 34 to form a toner metering gap 41. Controller 38 is composed of flexible but fairly rigid material compared to doctor blade 36. The purpose of controller 38 is to provide a controlled gap 41 to uniformly meter a predetermined amount of liquid developer through gap 41 to supply and maintain the meniscus 44 (shown in FIG. 2) formed between the applicator roll 34 and the recording medium 40 during operation of apparatus 10. The gap 41 between the flow controller 38 and the applicator roll 34 should be about two to three times the width of the development gap 35 between recording medium 40 and applicator roll 34 to insure sufficient liquid developer supply to maintain a uniform meniscus 44. In the configuration of FIG. 1, gap 41 may be, for example, about 0.060 inch.

The prior art liquid developer apparatus employing an applicator roll do not employ a flow controller 38. They depend on drawing liquid toner or developer from a reservoir by viscous friction without any accompanying metering device of the type shown herein. Further, it should be noted that the liquid developer is supplied directly to the surface of applicator roll 34 via region 32 between doctor blade 36 and flow controller 38, i.e., roll 34 is not rotated in a reservoir of toner but toner is affirmatively applied to a portion of the surface of the roll 34 and, together with the controller 38, forming the metering function of apparatus 10 for controlling the formation and maintanence of the mensicus 44.

As an alternative embodiment, flow controller 38 may comprise a elastomeric flap, for example, a 0.002 inch thick Mylar flap. The flap rests against the applicator roll 34 under its own spring action but opens to provide a metering gap 41 when the pumping source of liquid developer is activated. When the pumping source is activated, the flap separates from the applicator roll 34 until it contacts the surface of the moving recording medium 40. This action creates a closed path for toner flow between the applicator roll 34 and the recording medium 40. When the movement of the recording medium is stopped and the pumping source for the liquid developer is stopped, the flap closes down against the applicator roll 34 immediately preventing any toner from being fed to the development gap 35 and contact the recording medium 40. Tests using the Mylar flap demonstrated uniform metering of the liquid developer to the gag 35 and the rate of liquid developer from the pumping source may be cut in half. Stain background or stop marks are very faint or not existant depending on the brand of recording medium employed.

The flow controller 38 shown in FIG. 1 is preferred, however, because the flexible flap, acting as a flapper valve, functions as a moving part which is subject to wear and fragility due to the hinged action of the flap and may, through the passage of time and use, become jammed resulting in deteriorated image quality.

As shown in FIG. 1, the recording medium 40 is supplied to the liquid developer apparatus 10 via guide rolls 46 and 48 and thence to the developing gap 35 between the applicator roll 34 and the backrest electrode roll 50. Backrest electrode need not be a roll but may also be a stationary conductive element as illustrated in the previously cited prior art. Backrest electrode roll 50 is rotatably mounted for rotation by the moving medium 40 and may have the same diameter as applicator roll 34 with a smooth finish surface, although its finish need not be a mirror finish like that of roll 34.

Roll 50 is rotatably supported on frame member 52 which may be moved, as indicated by arrow 53, vertically to a number of different gap forming positions and a full retracted position. Movement between the two positions may be achieved with the use of a position solenoid (not shown). Roll 50 is shown in FIG. 1 in an selected position forming the desired printing gap 35. In the full retracted position, roll 50 will be approximately at the same horizontal level as guide roll 48 so that the recording medium 40 will not be pressed into forming the development gap 35 but will be sufficiently above that point so as not to come in contact with any liquid developer. The full retracted positon is particularly useful in a multideveloper apparatus comprising a series of liquid development apparatus to develop a composite color electrographic image comprising a plurality of superimposed component images of different colors. In producing each component image, only one applicator roll should be in its gap forming position while other applicator rolls are in their full retracted position thereby rendering them inactive. An example of this type of configuration is shown in U.S. patent application Ser. No. 444,144, filed Nov. 24, 1982 and assigned to the assignee herein. Good image quality depends on the liquid developer and the manufactured type of recording medium being employed. The adjustable nature of the development gap 35 permits swift and accurate correction for liquid developer and recording medium tolerances.

A number of different incremental gap forming positions are possible so that the width of the development gap 35 may be selectively altered to meet changes in various development parameters, such as, different recording medium absorption or conductivity or different electrical and physical toner characteristics.

The dimension of the development gap 35 between rolls 34 and 50 is dependent upon several factors including the size of these rolls, the tolerances involved in the operation of these rotaing rolls, the viscosity of the liquid developer, and importantly, the amount of voltage bias that may be applied to thes rolls. As an example, it has been found for the configuration illustrated in FIG. 1 that the gap may be 0.015 inch. A smaller gap increases the toning density and a large gap decreases the toning density. With a larger gap, e.g. 0.020 inch, the density of the image developed can be increased by increasing the rotational velocity of the applicator roll 34. By the same token, with a smaller gap, e.g. 0.012 inch, the density of the image developed can be decreased by decreasing the rotational velocity of the applicator roll 34.

Figure 3:
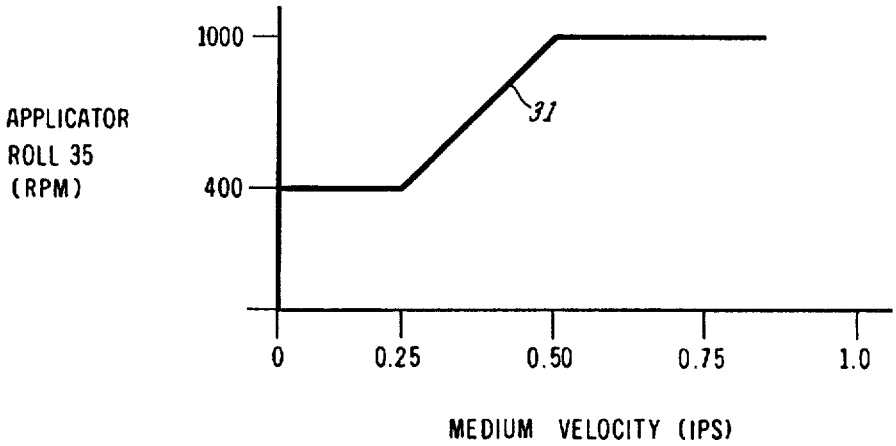
FIG. 3 is a graphic illustration of the optimum speed relationship between the rotational velocity of the applicator roll and rate of movement of the recording medium.

FIG. 3 illustrates the optimum relationship of applicator roll 35 rotational velocity whith recording medium 40 velocity for the configuration shown in FIG. 1. In an electrographic printer/plotter, the speed of the motor driving the applicator roll 34 would be controlled by the amount of medium velocity in accordance with the curve 31 illustrated in FIG. 3. The relationship illustrated by curve 31 prevents liquid toner from splashing as the toner comes into contact with applicator roll 34 due to the fact that the toner is not being carried away sufficiently fast if the roll 34 is not rotating sufficiently fast.

For the FIG. 1 configuration, the optimum rotational velocity for applicator 34 for medium 40 velocities below 0.25 ips is 400 rpm. For medium 40 velocities in excess of 0.50 ips, the optimum rotational velocity is 1000 rpm.

The prevention of stain or stop marks on the medium 40 due to medium stoppage is further achieved by the combination of the rotating applicator roll 34 removing the formed meniscus 44 from the development gap 35 and the deactivation of the pumping source.

Down stream from applicator roll 34 is a drying roll 58 which is rotatably mounted within the confines of frame 12 but at a horizontal level higher than that of applicator roll 34. Drying roll 58 may be identical to applicator roll 34 in material, finish and diameter, e.g. chrome plate steel with a one inch diameter. It is preferred that drying roll 58 have a mirror smooth finish to reduce the occurrence of any stain or stop marks when the movement of recording medium is intermittently stopped. Roll 58 rotated in a direction opposite to that of applicator roll 34 against the direction 43 of the medium and against the medium surface 40A to remove excess toner therefrom. Drying roll 58 is preferably longer than the width of the recording medium 40, e.g. one half inch beyond each edge of the medium to prevent the roll edges from leaving any marks or stains on the recording medium, particularly when the medium is intermittently stopped over the continuously rotating drying roll 58.

Roll 58 is kept clean of toner removed from medium surface 40A by means of a wiper or doctor blade 62. Blade 62 is held in position by means of the fairly rigid support member 63 which, together with the bottom portion of blade 62 are wedged into a groove 64 provided in fountain frame 18. Support member 63 is more rigid than blade 62 to provide good wedging action as well as firm back support for the efficient utilization of the blade in wiping the surface of drying roll 58.

The material for doctor blade 62 must resist softening and swelling in liquid developer and should provide good wear resistance while not creating excess friction on the surface of drying roll 58. A good material for these purposes is 95 shore D hardness urethane.

Drying roll 58 is preferably not rotated at the higher rotational velocities of applicator roll 34. As a rule of thumb, drying roll 58 is rotated at about one-fifth the velocity of applicator roll 34.

It is preferred that bias voltages be applied to applicator roll 34 via lead 56, backrest electrode roll 50 via lead 54 and drying roll 58 via lead 60. For the configuration shown in FIG. 1, wherein the charged image on medium surface 40A is negative, optimum conditions for bais applied to each of these rolls has been determined as shown in Table I.

TABLE I

| Roll | Rotational Velocity (rpm) | Voltage Bias (volts, DC) |
|---|---|---|
| Applicator Roll 35 | 400–1000 | −10 to −50 |
| Backrest Roll 50 | — | +10 to +50 |
| Drying Roll 58 | 80–400 | −10 to −20 |

Below about 10 volts on rolls 34 and 50, background stain, line bleeding and spreading as well as bleeding out of large dark areas of the developed image appear. Above about 80 volts, line streaks begin to appear on the medium. As the voltage is continually increased beyond 80 volts, the line streaks become more and more dense until finally the image is wiped out at about 400 volts leaving an all black image over the image bearing surface 40A.

The negative voltage bias on applicator roll 34 is important to the opeation of apparatus 10 in applying a force to the entrained toner particles in the liquid developer on roll 34 to be attracted toward the surface of roll against the inertia force tending to force the particles toward the recording medium surface 40A. This provides for uniform toning density as well as preventing the formation of a high density of toner particles in mensicus 44 in an area at the image bearing surface 40A. By the same token, a positive voltage bias on backrest electrode roll 50 forces toner particles toward the applicator roll surface and enhances, when the recording medium 40 is momentarily stopped, the elimination of background stain.

The exact amount of voltage bias required on rolls 34 and 50 for good image quality depends on the liquid developer and the manufactured type of recording medium being employed. It has been determined that if the conductivity of the developer solution is increased, the voltage bias on these rolls must be also increased to maintain image quality. If the recording medium surface is more porous, the voltage bias on these rolls must be increased to prevent the toning particles from "soaking" into the medium.

Increasig the voltage bias of rolls 34 and 50 when the medium 40 is stopped will reduce the ability for the formation of any stain stop marks on the medium. This increased bias may be accomplished by increasing the polarity bias on both rolls 34 and 50 or by increasing the voltage on one roll relative to another. However, it is critical that the voltages not be returned to their original values until the medium is again moving through apparatus 10. Any flunctuation or changes of bias voltages, particularyly when the medium is not moving, has the tendency to create more toner background stain.

Decreasing the width of development gap 35 decreases the required voltage on rolls 34 and 50 while increasing the development current in gap 35 via meniscus 44. By the same token, an icrease in the width of development gap 35 increases the required bias voltage to be applied to rolls 34 and 50.

A negative bias or some polarity bias as the charged image on medium surface 40A is applied to drying roll 58 via lead 60. The negative bias on drying roll effectively "erases" loosely attached toner particles on the image bearing surface 40A without smearing the particles on the image surface. The negative bias causes the excess toner particles to adhere to roll 58 rather than to medium 40. The excess toner particles are then cleaned from the surface of roll 58 by the action of doctor blade 62.

An example of rotational velocities and bias voltages for rolls 34, 50 and 58 is applicator roll 34 rotating at a velocity of 1000 rpm with a bias voltage of −15 volts, backrest electrode roll 50 with a bias voltage of +15 volts and drying roller rotating at a velocity of 150 rpm with a bias voltage of −15 volts.

While the invention has been described in conjunction with specific embodiments, it is evident that many alternatives, modifications and variations will be apparent to those skilled in the art in light of the foregoing description. Accordingly, it is intended to embrace all such alternatives, modifications, and variations as fall within the spirit and scope of the appended claims.

What is claimed is:

1. Liquid developer apparatus for developing an electrographic latent image formed on an image bearing surface of a recording medium with a liquid developer comprising a liquid carrier containing toning particles attractable to areas of said surface containing an imagewise charge of a first polarity comprising said latent image, said apparatus comprising a conductive applicator roll supported for rotational movement adjacent to the path of said recording medium forming a development gap therebetween, said applicator roll rotated in the direction of movement of said recording medium, a backrest electrode positioned on the opposite side of said recording medium to said applicator roll and across which said recording medium is drawn, a doctor blade supported against the surface of said applicator roll and positioned on the forward most position of said roll surface in the direction of the advancing recording medium, flow controlling means positioned between said doctor blade and said development gap and supported in spaced relation relative to said roll surface to form a metering gap, means to continually supply liquid developer to the surface of said applicator roll in a region between said doctor blade and said flow controlling means, means to rotate said applicator roll at high rotational velocity sufficient to produce a thin film of liquid developer on said roll surface and metered by said flow controlling means for forming a meniscus in said development gap relative to said moving recording medium, means to apply a voltage of said first polarity to said applicator roll, means to apply a voltage of a second polarity to said bakup electrode, a drying roll positioned down stream relative to the movement of said recording medium and supported for rotational movement against the surface of said recording medium, said dryer rotated in a direction opposite to the direction of movement of said recording medium to remove excess toning liquid from the surface thereof.

2. The liquid developer apparatus of claim 1 wherein a voltage of said first polarity is applied to said dryer roll to prevent smearing of excess liquid developer on said surface during the drying of said surface.

3. The liquid developer apparatus of claim 1 wherein is means to move said backrest toward and away from said applicator roll to selectively adjust the width of said development gap.

4. The liquid developer apparatus of claim 3 wherein said backrest electrode comprises a rotatably supported conductive roll.

5. The liquid developer apparatus of claim 1 wherein said backrest electrode comprises a rotatably supported conductive roll, means to move said back roll toward and away from said applicator roll to respectively position and remove said recording medium into and out of said development gap.

6. The liquid developer apparatus of claim 1 wherein said dryer roll is rotated about five times slower than said applicator roll.

7. The liquid developer apparatus of claim 1 wherein there is a doctor blade supported against the surface of said dryer roll on the leeward most portion of its surface away from the advancing recording medium.

8. The liquid developer apparatus of claim 1 wherei the amount of said applicator roll voltage is increased when said recording medium is not moving.

9. The liquid developer apparatus of claim 1 wherein thereis provided a laybrinth path for the travel of said liquid developer between said supply means and said established region.

* * * * *